US011783695B2

(12) United States Patent
Trundle et al.

(10) Patent No.: US 11,783,695 B2
(45) **Date of Patent: *Oct. 10, 2023**

(54) ALARM SIGNALING TECHNOLOGY

(71) Applicant: Alarm.com Incorporated, Tysons, VA (US)

(72) Inventors: Stephen Scott Trundle, Falls Church, VA (US); Alison Jane Slavin, Vienna, VA (US); Jean-Paul Martin, Oakton, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/752,951

(22) Filed: May 25, 2022

(65) Prior Publication Data

US 2022/0284801 A1 Sep. 8, 2022

Related U.S. Application Data

(63) Continuation of application No. 17/145,637, filed on Jan. 11, 2021, now Pat. No. 11,348,446, which is a continuation of application No. 16/740,711, filed on Jan. 13, 2020, now Pat. No. 10,891,851, which is a continuation of application No. 16/404,079, filed on May 6, 2019, now Pat. No. 10,535,251, which is a continuation of application No. 15/984,971, filed on May 21, 2018, now Pat. No. 10,282,974, which is a continuation of application No. 15/348,444, filed on Nov. 10, 2016, now Pat. No. 9,978,257, which is a continuation of application No. 14/691,196, filed on Apr. 20, 2015, now Pat. No. 9,495,864, which is a continuation of application No. 14/252,325, filed on (Continued)

(51) Int. Cl.

| | |
|---|---|
| ***G08B 29/04*** | (2006.01) |
| ***G08B 25/00*** | (2006.01) |
| ***G08B 29/02*** | (2006.01) |
| ***G08B 29/18*** | (2006.01) |

(52) U.S. Cl.

CPC ..... *G08B 29/046* (2013.01); *G08B 25/005* (2013.01); *G08B 25/006* (2013.01); *G08B 29/02* (2013.01); *G08B 29/185* (2013.01); *G08B 25/008* (2013.01)

(58) Field of Classification Search

CPC .... G08B 25/008; G08B 29/02; G08B 29/046; G08B 29/185; H04N 21/26208; H04N 21/266

See application file for complete search history.

(56) References Cited

U.S. PATENT DOCUMENTS 4,446,454 A 5/1984 Pyle
4,581,606 A 4/1986 Mallory (Continued)

OTHER PUBLICATIONS

U.S. Non-Final Office Action for U.S. Appl. No. 13/053,994 dated Mar. 28, 2013, 12 pages.

(Continued)

*Primary Examiner* — Mirza F Alam
(74) *Attorney, Agent, or Firm* — Fish & Richardson P.C.

(57) ABSTRACT

Techniques are described for handling an event where a control panel or an alarm signaling device is tampered with or destroyed by a disablement tactic, e.g., a "crash and smash intrusion."

20 Claims, 9 Drawing Sheets

Related U.S. Application Data

Apr. 14, 2014, now Pat. No. 9,013,295, which is a continuation of application No. 13/947,207, filed on Jul. 22, 2013, now Pat. No. 8,698,614, which is a continuation of application No. 13/053,994, filed on Mar. 22, 2011, now Pat. No. 8,493,202.

(60) Provisional application No. 61/316,034, filed on Mar. 22, 2010.

(56) References Cited

U.S. PATENT DOCUMENTS

| | | | |
|---|---|---|---|
| 4,777,474 | A | 10/1988 | Clayton |
| 5,027,383 | A | 6/1991 | Sheffer |
| 5,195,126 | A | 3/1993 | Carrier et al. |
| 5,438,607 | A | 8/1995 | Przygoda et al. |
| 5,499,014 | A | 3/1996 | Greenwaldt |
| 5,621,385 | A | 4/1997 | Carney |
| 5,638,046 | A | 6/1997 | Malinowski |
| 5,777,551 | A | 7/1998 | Hess |
| 5,861,804 | A | 1/1999 | Fansa et al. |
| 5,867,105 | A | 2/1999 | Hajel |
| 5,892,442 | A | 4/1999 | Ozery |
| 6,032,036 | A | 2/2000 | Maystre et al. |
| 6,035,016 | A | 3/2000 | Moore |
| 6,049,272 | A | 4/2000 | Lee et al. |
| 6,049,273 | A | 4/2000 | Hess |
| 6,052,052 | A | 4/2000 | Delmonaco |
| 6,133,830 | A | 10/2000 | D Angelo et al. |
| 6,211,783 | B1 | 4/2001 | Wang |
| 6,295,346 | B1 | 9/2001 | Markowitz et al. |
| 6,369,705 | B1 | 4/2002 | Kennedy |
| 6,661,340 | B1 | 12/2003 | Saylor et al. |
| 6,741,171 | B2 | 5/2004 | Palka et al. |
| 6,965,313 | B1 | 11/2005 | Saylor et al. |
| 7,113,090 | B1 | 9/2006 | Saylor et al. |
| 7,126,473 | B1 | 10/2006 | Powell |
| 7,248,157 | B2 | 7/2007 | Bergman et al. |
| 7,619,512 | B2 | 11/2009 | Trundle et al. |
| 7,956,735 | B2 | 6/2011 | Jackson |
| 9,978,257 | B1 | 5/2018 | Trundle et al. |
| 10,156,959 | B2 | 12/2018 | Fulker et al. |
| 10,282,974 | B1 | 5/2019 | Trundle et al. |
| 2002/0147982 | A1 | 10/2002 | Naidoo et al. |
| 2002/0163997 | A1 | 11/2002 | Bergman et al. |
| 2002/0167590 | A1 | 11/2002 | Naidoo et al. |
| 2003/0184436 | A1 | 10/2003 | Seales et al. |
| 2008/0001734 | A1 | 1/2008 | Ship et al. |
| 2009/0121860 | A1 | 5/2009 | Kimmel et al. |
| 2010/0122280 | A1* | 5/2010 | Sofos ..... H04N 21/25841 725/25 |
| 2011/0222508 | A1 | 9/2011 | Zinser et al. |
| 2011/0234392 | A1 | 9/2011 | Cohn et al. |
| 2012/0020484 | A1 | 1/2012 | Grancharov |
| 2013/0015966 | A1 | 1/2013 | Soomro et al. |
| 2016/0171853 | A1* | 6/2016 | Naidoo ..... H04N 7/18 348/143 |
| 2016/0239794 | A9* | 8/2016 | Shafer ..... G06Q 10/087 |
| 2020/0322283 | A1* | 10/2020 | Osterlund ..... H04L 47/74 |

OTHER PUBLICATIONS

U.S. Notice of Allowance for U.S. Appl. No. 13/053,994 dated Jun. 7, 2013, 6 pages.
U.S. Non-Final Office Action for U.S. Appl. No. 14/252,325 dated Sep. 29, 2014, 10 pages.
U.S. Notice of Allowance for U.S. Appl. No. 14/691,196 dated Aug. 17, 2016, 6 pages.
U.S. Non-Final Office Action for U.S. Appl. No. 15/348,444, dated Feb. 2, 2018, 15 pages.
U.S. Notice of Allowance for U.S. Appl. No. 15/348,444, dated Apr. 13, 2018, 9 pages.
U.S. Non-Final Office Action for U.S. Appl. No. 16/404,079, dated Sep. 27, 2019, 9 pages.
U.S. Notice of Allowance for U.S. Appl. No. 16/404,079, dated Nov. 29, 2019, 9 pages.

* cited by examiner

ALARM SIGNALING TECHNOLOGY

CROSS-REFERENCE TO RELATED APPLICATIONS

This application is a continuation of U.S. patent application Ser. No. 17/145,637, filed Jan. 11, 2021, which is a continuation of U.S. patent application Ser. No. 16/740,711, filed Jan. 13, 2020, which is a continuation of U.S. patent application Ser. No. 16/404,079, filed May 6, 2019, which is a continuation of U.S. patent application Ser. No. 15/984,971, filed May 21, 2018, which is a continuation of U.S. patent application Ser. No. 15/348,444, filed Nov. 10, 2016, which is a continuation of U.S. patent application Ser. No. 14/691,196, filed Apr. 20, 2015, which is a continuation of U.S. patent application Ser. No. 14/252,325, filed Apr. 14, 2014, which is a continuation of U.S. patent application Ser. No. 13/947,207, filed Jul. 22, 2013, which is a continuation of U.S. application Ser. No. 13/053,994, filed Mar. 22, 2011, which claims the benefit of U.S. Provisional Application No. 61/316,034, filed Mar. 22, 2010. All of the prior applications are incorporated herein by reference in their entirety.

FIELD

The present disclosure relates to alarm signaling technology. For example, the present disclosure relates to the field of security systems, in particular to a system and method for automatically providing alarm signaling to inform an owner and other authorized entities in a manner predetermined by the user when alarm situations and/or alarm worthy situations occur while an alarm system is being intentionally destroyed.

BACKGROUND

Security systems are typically implemented by either wired or wireless sensors in the property being protected. These sensors may consist of door contacts, window contacts, glass-break detectors, motion sensors, and other types of intrusion detection sensors, as well as other environmental sensors like smoke, fire, carbon monoxide, and flood sensors. When a sensor is tripped, the system may sound a local siren, or notify an offsite host station of the event, or both.

Depending on the type of sensor tripped, the system may wait for a period before sounding the alarm or notifying the host station so that the property owner or manager will have an opportunity to disarm the system. Recently, with the goal of reducing of the overall false alarm rate that has troubled the industry, the Security Industry Association (SIA) has also advocated that most residential security systems be programmed with an automatic alarm signaling delay for all intrusion alarms so that the homeowner has more time to cancel false alarms. Many security control panels today may be shipped with an SIA suggested "dialer delay" feature enabled. Security systems, which notify a host station of an alarm, are called "monitored security systems." These systems most often notify the host station, e.g., "central station", of the alarm by using, for example, telephone lines, e.g., POTS (plain old telephone service), or other landline (broadband) connection. These systems, however, may be defeated by physically cutting or otherwise disabling the line connection to the property. If the connection to the property is cut before or immediately after an unauthorized intruder enters the property, then the system may not report the alarm to the host station.

To counter line disablement, some security systems are upgraded to send alarm signals to the host station via a wireless radio. When wireless signaling from the security system to the host station occurs, the security system cannot be disabled by merely cutting the landline connection to the home or business. Nevertheless, a wireless radio-signaling device may still be vulnerable to attack. One common tactic used by intruders is a tactic known as the "crash and smash" technique.

In implementing the "crash and smash" technique, a savvy intruder may effectively disable phone lines (or other wired connections) as well as wireless signaling devices before a traditional alarm system is able to contact a user. To implement the "crash and smash" technique, the intruder crashes through a door, for example, that is programmed to delay. The delay is typically programmed by the system designer to allow the homeowner or property manager enough time to disarm their security system before the alarm is sounded, or the host station is notified. During this delay period, the system is waiting to be disarmed. Although these delay periods typically last about one minute, in response to high false alarm rates and high fines for false alarms, these delay periods are being programmed to be longer, sometimes as long as three to five minutes, and many systems today may be programmed with a signaling delay implemented for most intrusion alarms, even if the alarm was tripped by a sensor that is not on a commonly used access to the property. This delay period provides the savvy intruder enough time to crash through the door and smash the security control panel and the wireless signaling device while the control panel is waiting to be disarmed or while the system is attempting to establish an analog (dial-up) phone connection with the host station. In this way, the security system is defeated.

SUMMARY

Techniques are described for handling an event where a control panel or an alarm signaling device is tampered with or destroyed by a disablement tactic, e.g., a "crash and smash intrusion."

A typical alarm system uses a telephone connection to report an alarm signal. A phone line based signal has a latency that is driven by (a) the need to capture the phone connection and (b) the time required to auto-dial the designated phone number, wait for an answer, and establish a handshake with the receiver. But despite these drawbacks, the telephone connection, for a variety of reasons, remains the primary signaling channel for most security system installations.

In some implementations, a system may provide immediate transmission of a potential alarm to a remote alarm signal escrow site via a wired or a wireless signal. For instance, the system may use a wired or a wireless TCP/IP message. Messages delivered through a wireless radio, or an active TCP/IP channel may typically be sent much more quickly than an alarm signal that needs to be sent across the phone line. The escrow site may then wait for a confirmation update that the alarm signal has been sent through the designated channel or communication path, usually through the telephone line, to the host station, or for notification update that the alarm was cancelled, or for notification update that the primary signaling channel has been disabled. In each case, the wireless radio or TCP/IP message channel may be used to send updates on the status of the signal to the escrow site. If the escrow site does not receive an update that the alarm has been successfully transmitted or cancelled, then the escrow site may determine that the control panel and/or the signaling device was possibly damaged during the intrusion. As a result, the escrow site may forward the update to the host station to signal the alarm situation. Likewise, if the update signals that the phone line has been disabled or damaged, a notification update of the alarm situation may be forwarded from the escrow site to the host station.

In some examples, real-time event analysis may also be used to protect against "crash and smash" intrusions. In this case, monitor data from one or more sensors in a protected location may be gathered and forwarded to a remote escrow site for real-time expected event analysis where the software operating at the escrow site identifies event sequence anomalies which may indicate tampering with the security control panel by comparing the actual monitor data against data which is expected. For example, if a security system is armed to report alarms, and a door is opened, the software would expect to receive either an event indicating that the system had been disarmed, or that the alarm had been triggered because the system was not disarmed within the prescribed delay period. In this example, if the software received an event indicating that a door sensor was tripped, but did not subsequently receive an event indicating a disarming or an alarm in a prescribed period of time, then the software would surmise that the security control panel or alarm signaling device had been disabled. The remote escrow site may be any remote location that is independent of the security control panel, typically a secure offsite location. If an event anomaly is identified, a notification message may be sent to the property owner, property manager, emergency authorities, or a host station indicating that a "crash and smash" intrusion is likely in progress.

Additional advantages will be set forth in part in the description which follows, and in part will be apparent from the description, or may be learned by practice. The advantages may be realized and attained by the instrumentalities and combinations particularly pointed out below.

The accompanying drawings, which are incorporated in and constitute a part of this specification, illustrate various implementations.

DETAILED DESCRIPTION

Figure 1:
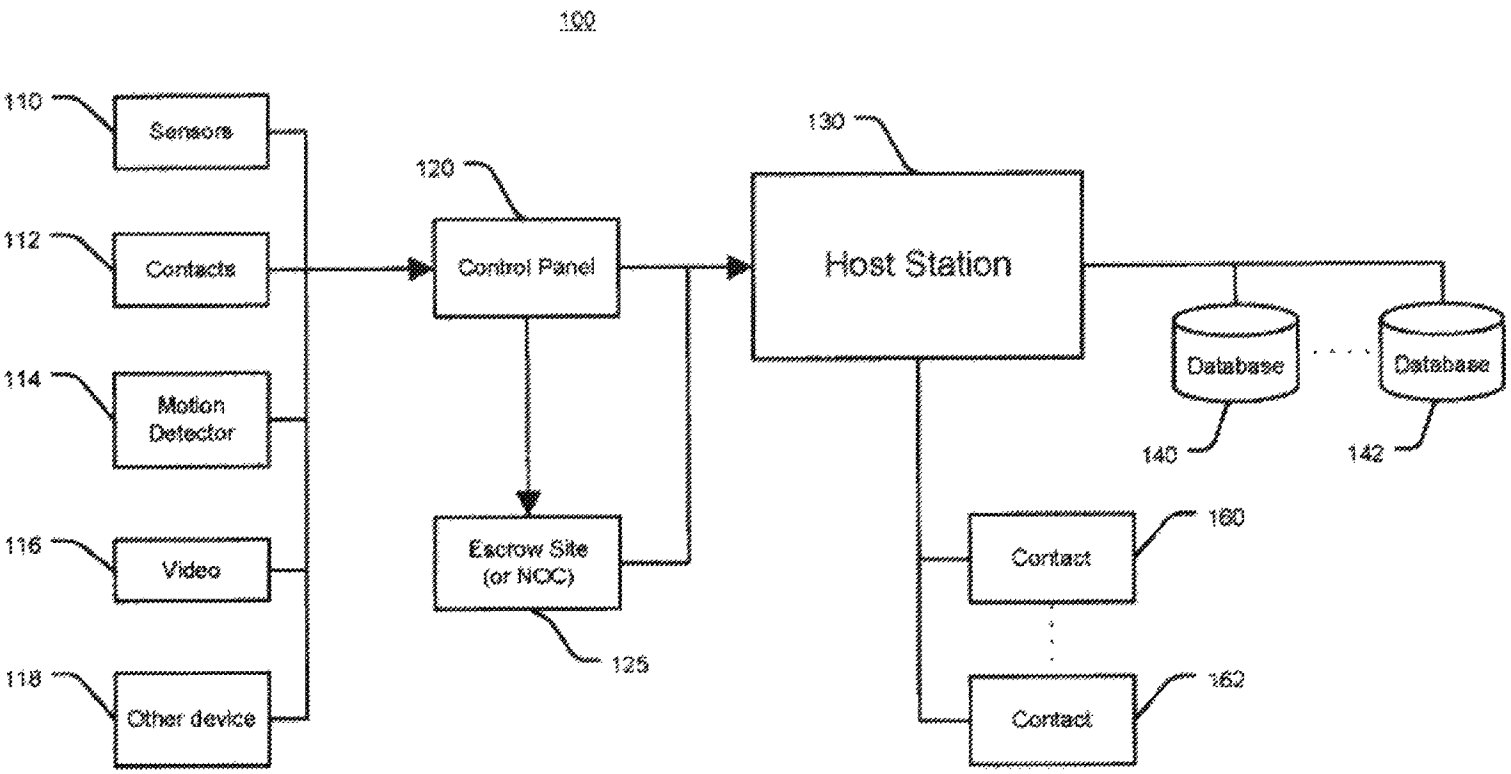
FIG. 1 is an exemplary diagram illustrating a system for alarm signaling.

Techniques are described for immediate transmission of a potential alarm to a remote alarm signal escrow site to provide alarm signaling in the event where a control panel or an alarm signaling device is being tampered with or destroyed by a disablement tactic, e.g., a "crash and smash intrusion." Crash and smash intrusions are becoming increasingly common. Here, an intruder may recognize that an alarm signal may be sent using a phone line or via wireless radio from the protected property. As a result, a phone line (or other wired connections) may be easily disabled prior to an intrusion. Although wireless signaling devices may be more difficult to compromise, an intruder may still disable such devices if the intruder locates the control panel and/or signaling device and physically destroys the device before an alarm signal is sent.

In order to successfully execute a "crash and smash" intrusion or other similarly destructive intrusions, an intruder, for example, may first attempt to identify the door or doors that a property owner or manager would typically use to enter the protected premise when the alarm system is armed. These doors may often be programmed to allow the property owner or manager to enter the premise and go to a control panel having, e.g., a touchpad, where they may disarm or cancel the alarm system before the alarm system triggers. Other entries ways may also be identified, e.g., garage door, back door, or other entrance. Most alarm systems may have a predetermined time period, e.g., thirty or sixty seconds or even longer, to disarm the system after entering the premises through a designated portal. In an effort to reduce the typically high false alarm rates, many systems today may be programmed with significant delay between the triggered alarm state and the alarm-signaling event so that accidental false alarms may be cancelled and unnecessary police dispatches may be avoided. If the system is not properly disarmed after this allotted time, an alarm may be triggered. If an intruder cuts the phone line prior to intrusion, an additional signaling delay may be incurred since many security control panels (e.g., the GE Simon control panel) may repeatedly attempt to send their signal via the phone line. Additional signaling delays may be incurred because these attempts to send an alarm signal via a wired connection may occur several times before a system attempts to send a signal via wireless radio. A savvy intruder may understand these processes and take advantage of these delays by crashing through the door expected to be programmed with a delay, or attacking properties installed by security companies known to install systems with high delays so that false alarms may be reduced, and then going directly to the control panel to smash or destroy it. He or she may also destroy the alarm signaling gear in the process. All this may take place even before the alarm delay period expires. As a result, the premeditated attack may provide an intruder one or more minutes of intrusion time. Other variations to the above-described intrusion may also be considered.

When an alarm situation occurs, a message may also be immediately sent via a second connection path such as a wireless radio or a TCP/IP signal channel to a remote alarm signal "escrow site" even if the panel has been programmed to primarily transmit alarms (e.g., an alarm signal) through the phone line. In one implementation, the escrow site may be a Network Operations Center (NOC). The wireless radio or other signaling device may also send to the escrow site an update identifying the situation. For example, the update may include information about the alarm signal that the control panel is attempting to send through the telephone connection or other primary connection, an acknowledgement that the alarm signal has been successfully transmitted through its primary connection, that the phone line (or other forms of connectivity) has been disabled, or that the alarm signal has been effectively cancelled. The update may also identify other similar situations. If the escrow site does not receive an update that the alarm signal has been successfully transmitted, the escrow site may determine that the control panel and/or the signaling device may have been damaged during the intrusion. As a result, the escrow site may forward an update to inform the host station of the alarm situation, e.g., the crash and smash intrusion. Likewise, if the update indicates that the phone line has been disabled or damaged, the escrow site may forward an update to inform the host station. The remote alarm signal escrow site may choose not send an update to the host station if the alarm signal was successfully transmitted or if the property owner or manager properly disarmed or the cancelled the alarm signal.

FIG. 1 is a graphical representation of an example security network system 100. More specifically, FIG. 1 is an exemplary diagram illustrating an example system for alarm signaling. Security system 100 may include a plurality of monitor devices of varying type that transmit data to a control panel 120, which may be integrated with or separate from a control panel or other similar device. The monitor devices may include sensor 110, contact 112, motion detectors 114, video recorder 116 and/or other device 118. The monitor devices may be located at the same location, affiliated location, remote location, etc. The monitor devices may span across multiple subscribers and/or across multiple locations.

Control panel 120 may transmit alarm information to a host station 130. The host station 130 (which may also be known as a "central monitoring station") may process the alarm situation, status data and/or other relevant information. Control panel 120 may be local or remote from the sensors. The control panel 120 in this implementation may interpret sensor data and determine if sensor data and user actions (or lack thereof) constitute an alarm condition. The control panel 120 may gather monitor data and forward the monitor data to host station 130. In addition, the control panel 120 may function as a messaging hub to buffer the monitor data and facilitate data transmission. Control panel 120 may transmit the monitor data via various modes of communication, including by way of example wireless communication, broadband, WiMax, etc. Communication may be established through various mediums. An example may include a radio modem (e.g., CreataLink 2XT radio modem), which may transmit radio waves at a predetermined frequency (e.g., 900 MHz). Such radio waves may then be received by the host station 130 or at an intermediary system that relays the signal over a secondary communication channel (e.g., TCP/IP system) to host station 130. Other examples of modes of communication may include POTS (plain old telephone service), cable modem, DSL (digital subscriber links), wireless (two-way pager, packet switched, telephone cellular networks, GSM cellular networks, CDMA cellular networks) and others. Other device 118 may also include a user interface box, connected over a long-range network or other network to host station 130 and/or control panel 120.

Escrow site or NOC 125 may receive an alarm signal from the control panel 120 to forward to the host station 130. The escrow site 125 in this implementation functions as a secondary or back-up line of transmission for the control panel 120 to communicate with the host station 130. The escrow site 125 may use a software program to monitor activities tracked by the monitor devices and analyze system event sequences that would indicate a crash and smash intrusion. The host station 130 may then receive data from the control panel 120 and/or escrow site 125 and/or use an additional software program to indicate a crash and smash intrusion.

According to another implementation, the monitor devices may transmit data directly to the host station 130, thereby bypassing the control panel 120. Monitor devices (e.g., sensors 110, contacts 112, motion detector 114, video 116 and/or other device 118, etc.) may communicate individually to the host station 130 via various modes of communication, including wireless communication, broadband (wireless and/or wired) and/or other methods including the use of a secondary control panel. They may also directly communicate with the escrow site 125. Devices (e.g., sensors, monitors, etc.) may monitor activity levels and be controlled across multiple locations through one or more interfaces. The host station 130 may receive monitor data from the various remote devices for compiling, processing and/or responding. Other actions may also be taken in response to the data.

Databases 140, 142 may store relevant information for processing the monitor data as desired by a subscriber. Exemplary database information may include user information, alarm events, reports, sensor and system event sequences, and/or other information. While shown as separate databases, it should be appreciated that the contents of these databases may be combined into fewer or greater numbers of databases and may be stored on one or more data storage systems. User information may be obtained from user database 140.

Databases 140, 142 may also store relevant information for personalized alarm services. Alarm events and other information may be stored in alarm events database 142. A user may generate reports based on historical and/or other data, which may be stored in reports database 144. Other information may be accessed and/or stored in other database 146. In addition, subscribers and/or other designated recipients, as shown by contacts 160-162, may be alerted or notified of certain events, triggers, reports and/or other desired information, via various preferred modes, including by way of example, POTS, cable modem, DSL, wireless, broadband, etc. Based on user preferences and other information, the user may be notified via various methods of communication, as specified in the user's profile and preferences information. Alert notification may be communicated via the Internet, POTS, wireless communication portals, voice portals, and/or other methods. Contact individuals and/or entities 160-162 identified by the user may also receive alert notification in an order determined by the user. The contact order and other actions may be predetermined. In addition, the user may select contact order and/or other actions through menu options at the time of alarm situation notification. An emergency entity, such as police, fire department, and/or rescue squads, may also receive alert information.

A user may register various types of security devices, including those associated with property, personal property, and/or individuals with the host station 130. Property may include user's home, office, vacation house or other locations. The security system may also be applied to a user's personal property, such as a car, boat or other mobile property. A security system may encompass personal security devices for individuals, such as a panic device. Other objects, locations, and property may be protected.

Various security devices may be associated with each location, item of personal property, or individual within the security network. For property, security devices may include sensors, detectors and/or other devices for detecting alarm situations. For individuals, security devices may include a panic button or other similar device. Other security devices may be implemented with the system.

In some examples, security devices may be predominantly wireless and communicate locally over short-range radio or other modes of communication. Each of the sensors (or group of sensors) may be equipped with a transmitter and the control panel may be equipped with a receiver. A control panel may receive regular status information from the sensors and may be alerted when a sensor detects an alarm situation. The control panel may receive other information. Transmission of regular status information may occur at predetermined intervals, as well. For example, the sensors may send digital data packets providing status and other data at 10-second intervals, for example. Also, on or off status information may be conveyed to the escrow site 125 and/or host station 130.

Figure 2:
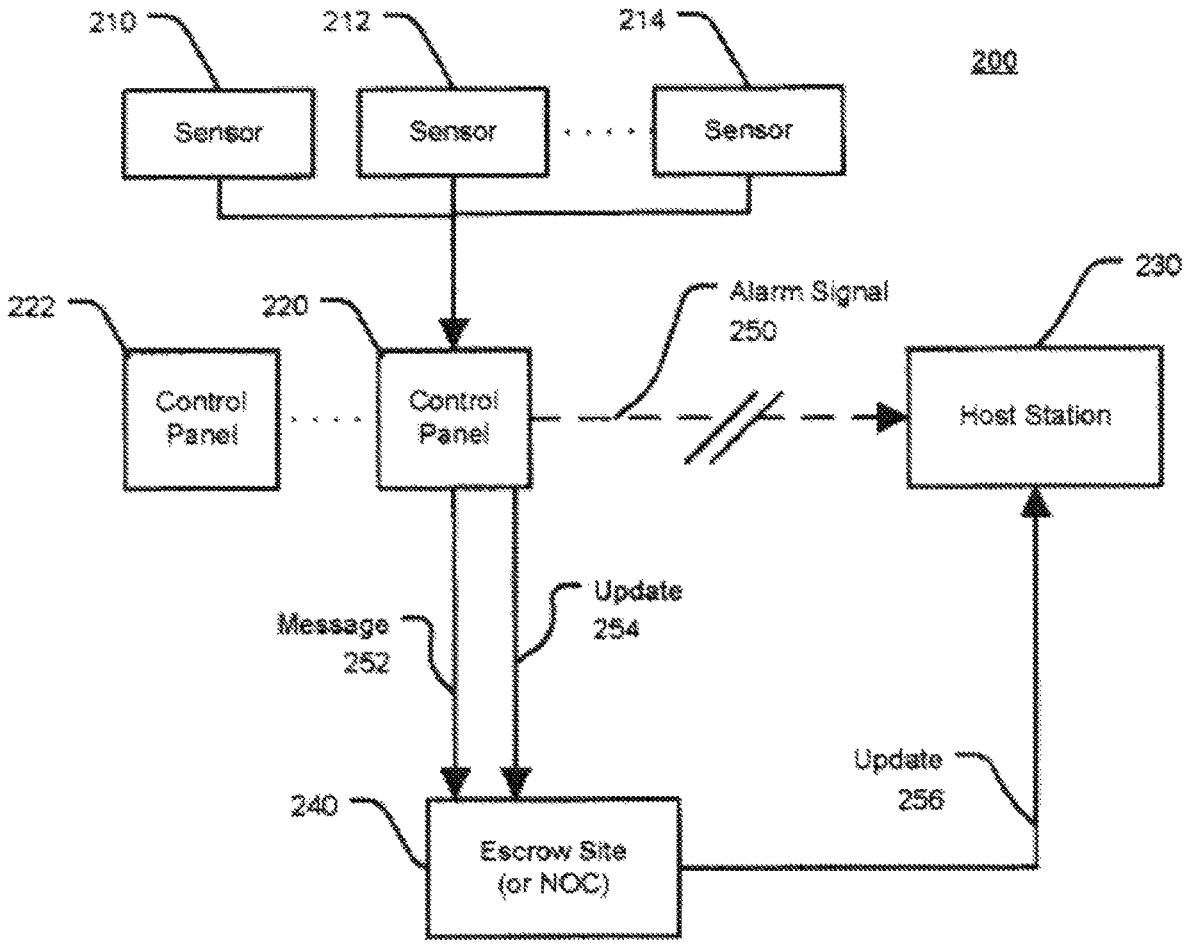
FIG. 2 is another exemplary diagram illustrating an escrow site alarm signaling system.

FIG. 2 is an exemplary diagram illustrating an example system for escrow site alarm signaling. One or more sensors 210, 212, 214 may indicate an alarm event, e.g., a door opening, etc. Sensors 210, 212, 214 may be located within a single unit (e.g., house) or across multiple locations (e.g., chain of stores). Control panel 220 may send an alarm signal via a first communication path, e.g., a phone line (or other wired connection), in response to the alarm situation detected by one or more sensors 210, 212, and/or 214. Additional control panels represented by 222 may be implemented.

The alarm signal may be sent to a host station 230, as shown by 250. A message 252 may be sent via wireless radio. The message may be sent to a separate alarm signal escrow site 240 or NOC, as shown by 252, via a second communication path, e.g., a wireless radio. The escrow site 240 may be remote or local from the host station 230. In one implementation, the message may be sent simultaneously with the alarm signal or shortly before or after the alarm signal. The wireless radio may also send an update 254 that provides information concerning the alarm event. For example, the update 254 may include data indicating that the alarm signal has been successfully transmitted, the control panel has detected that the phone line or other wired connection, e.g., broadband, has been disable (e.g., physically cut by an intruder), or a cancellation of the alarm signal.

If the escrow site 240 fails to receive any message or receives the message indicating that the wired connection has been disabled, the escrow site may then forward the update to the host station 230, as shown by 256, to indicate the likelihood of a crash and smash intrusion. For example, the alarm signal may not be received by the host station 230, as shown by 250. Receipt of the update at the escrow site, however, that the alarm signal was successfully transmitted or effectively cancelled may result in no further signaling by the escrow site. Host station 230 may then respond accordingly.

Although the control panel has been described as being able to communicate directly with the host station, in some implementations, the control panel does not communicate directly with the host station. In these implementations, the escrow site is the primary communication pathway between the control panel and the host station. As such, in these implementations, all alarm signaling from the control panel goes through the escrow site regardless of whether the alarm signaling relates to a typical alarm event or a crash and smash intrusion.

Figure 3:
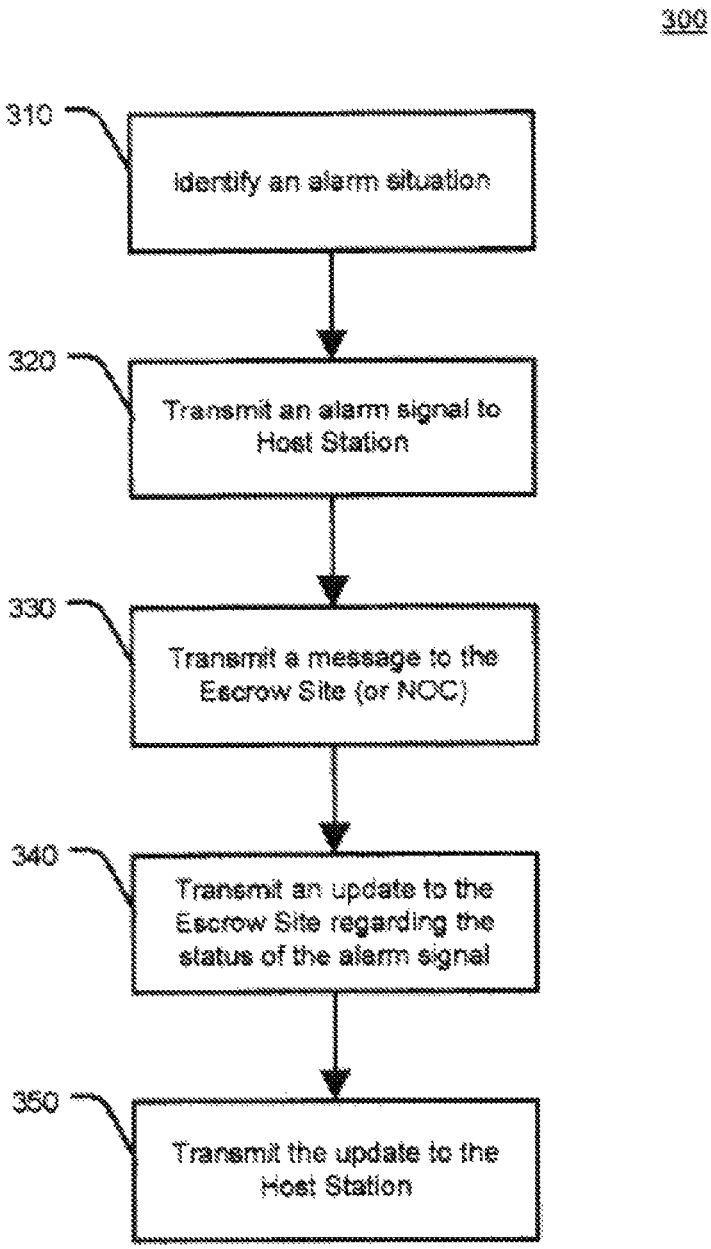
FIG. 3 is an exemplary flowchart illustrating a method for escrow site alarm signaling.

FIG. 3 is an exemplary flowchart illustrating an example method for escrow site alarm signaling. At step 310, an alarm situation maybe identified. The alarm situation may include entry of a primary door (or other entry ways) onto a protected location. The primary door may include the door in which a property manager or owner or other delegate enters before disarming the alarm system. Other alarm situations may also include a combination of sensors and/or monitor devices in a variety of locations, and any situation where cancellation of the alarm system may be warranted. The location may include a subset within a location (e.g., one or more rooms within a home, etc) or one or more locations (e.g., stores at different areas, etc.). Cancellation of an alarm signal may include, for example, disarming an alarm system by the entry of a passcode in the touch pad of a control panel, a key, or other suitable mechanisms. Other methods of disarming may also be implemented, such as voice recognition, retina scanning, fingerprint identifications, etc. Here, a predetermined time delay may be implemented for a property owner or manager to cancel an alarm signal.

At step 320, an alarm signal may be sent from a control panel to a host station via a first communication path, e.g., a phone line (or other similar connection), in response to an identification of an alarm situation 310. The alarm signal may be sent to a host station.

At step 330, a message may be sent via a second communication path, e.g., a wireless radio (or other similar connection). The message may be sent from the control panel (or individual monitor devices) to a remote alarm signal escrow site or NOC. In one implementation, the message may be sent simultaneously with the alarm signal or shortly before or after the alarm signal.

At step 340, the wireless radio may also send an update identifying the situation. For example, the update may indicate that the alarm signal sent via the first communication path has been successfully transmitted, the control panel has detected that the phone line or other wired connection, e.g., broadband, has been disabled (e.g., physically cut by an intruder), or a cancellation of the alarm signal. Other events or situations may also be identified by the message.

At step 350, the message may be transmitted to the host station in response to the message received at the escrow site. If the escrow site fails to receive any message or receives the message indicating that the wired connection has been disabled, the escrow site may then forward the update to the host station to indicate the likelihood of a crash and smash intrusion, as shown in step 340. Receipt of the update that the alarm signal was successfully transmitted or effectively cancelled may result in no further signaling by the escrow site.

Figure 4:
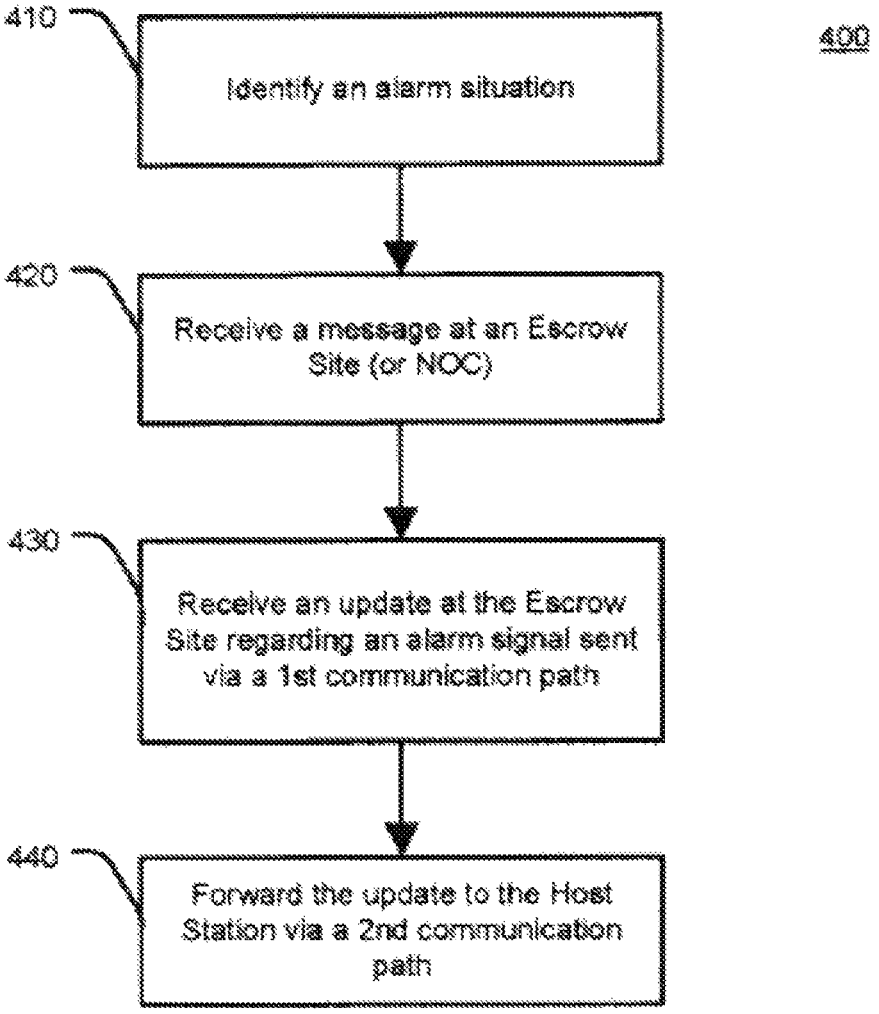
FIG. 4 is an exemplary flowchart illustrating a method for escrow site alarm signaling.
Figure 5:
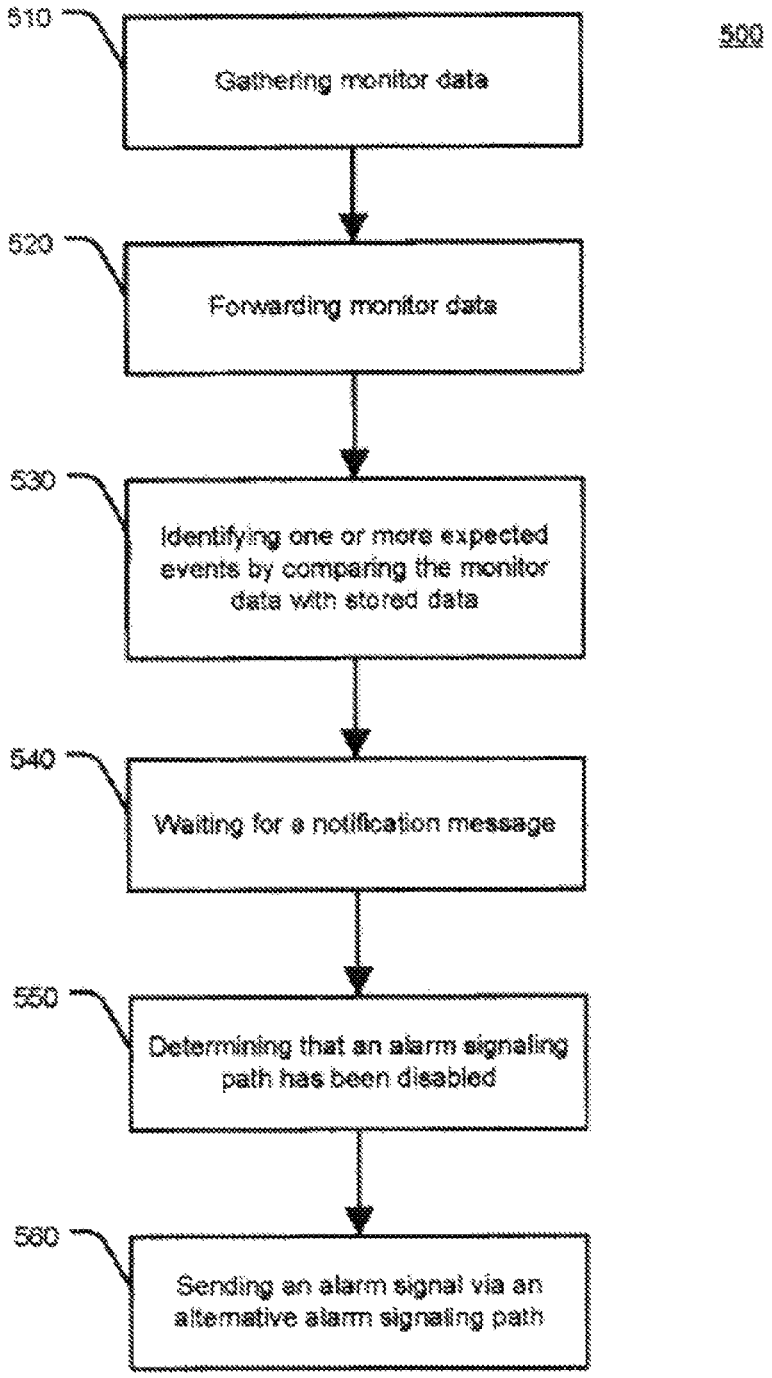
FIG. 5 is an exemplary flowchart illustrating a method for alarm signaling using real-time event analysis.

FIG. 4 is another exemplary flowchart illustrating an example method for escrow site alarm signaling. At step 410, an alarm situation may be identified at a location. At step 420, the escrow site may receive a message from the control panel or from one or more monitor devices indicating the alarm situation.

At step 430, the escrow site may also receive a message identifying the situation. For example, the message may indicate that the alarm signal has been successfully transmitted, the control panel has detected that the phone line or other wired connection, e.g., broadband, has been disabled (e.g., physically cut by an intruder), or a cancellation of the alarm signal. Other events or situations may also be identified by the message.

At step 440, the escrow site may forward or transmit an update to the host station to indicate a crash and smash intrusion if the escrow site fails to receive any message or receives the message indicating that the wired connection has been disabled.

Real-time event analysis may also protect against crash and smash events. Here, an offsite system (e.g., in a home, office, etc.) as described above in connection with FIG. 1, may be capable of monitoring and instantly reporting each important single sensor and keypad event occurring in a particular property before and during an alarm event. Some or all sensor and system events (e.g., 110, 112, 114, 116, 118, etc.) may be immediately sent through one or more messages via broadband connection or wireless signaling to a control panel 120 or an NOC 125, both of which may be remote, where sensors may be monitored and system event sequences analyzed to indicate symptoms of a crash and smash attack.

According to one example, if a security system is armed and a door that is programmed for a delayed alarm is opened, a message may be immediately sent to a control panel 120 or NOC 125 indicating that the door has been opened when the alarm was armed. The host station 130 may then know to expect that it should receive, within a predetermined amount of time, a message notification that the alarm system has been disarmed or that the alarm was not properly disarmed. If the host station receives no notice of either within that proscribed amount of time, then the host station may be made aware that the alarm system and/or signaling device in the property may have been damaged, disabled, or otherwise tampered with. Accordingly, an alarm event notification may then be sent to the escrow site 125 and/or to property owners or other delegates about the intrusion.

According to another implementation, the sensors themselves may simply message their state (or other information) to a host station and the "security system" is essentially just a defined collection of sensors that send their state and unique identification (and/or other information) to the host station via a network (e.g., wireless, broadband, etc.). The same sensor may be defined to be included in several different security systems at the same time. For example, sensors 4, 5, 6 and 7 may together constitute the security system for a stock room, while sensors 4, 6, 8, 9, 10, 11, 12 and 14 may represent the security system for a building. In the case of both systems, there may be no traditional control panel involved as the sensors simply message their state and unique identity directly, or via a data hub, to the escrow site and/or host station or to software operating at a central NOC that may be capable of servicing multiple systems simultaneously.

The term "wireless" may include long-range wireless radio, local area wireless network such as 802.11 based protocols, wireless wide area network such as WiMax and/or other similar applications.

In some implementations, a history of average signal strength for a secured location is used to determine a wait time for an alarm signal from the secured location that is in escrow. In these implementations, a history of communications with the secured location is analyzed to compute the average signal strength for alarm signals originating from the secured location. The computed average signal strength is then used to intelligently set a wait time for an alarm signal in escrow that accounts for the computed average signal strength. For instance, a relatively short wait time (e.g., two minutes) may be set for a first secured location that has a relatively high average signal strength and a relatively long wait time (e.g., three minutes) may be set for a second secured location that has a relatively low average signal strength. In this regard, faster detection of an alarm destruction event may be achieved for the first secured location because the first secured location has a relatively high quality signal that is less likely to suffer a communication error. In addition, the likelihood of detecting a false alarm destruction event due to a communication error may be reduced for the second secured location because a longer wait time is given to receive the relatively low quality signal from the second secured location.

Figure 6:
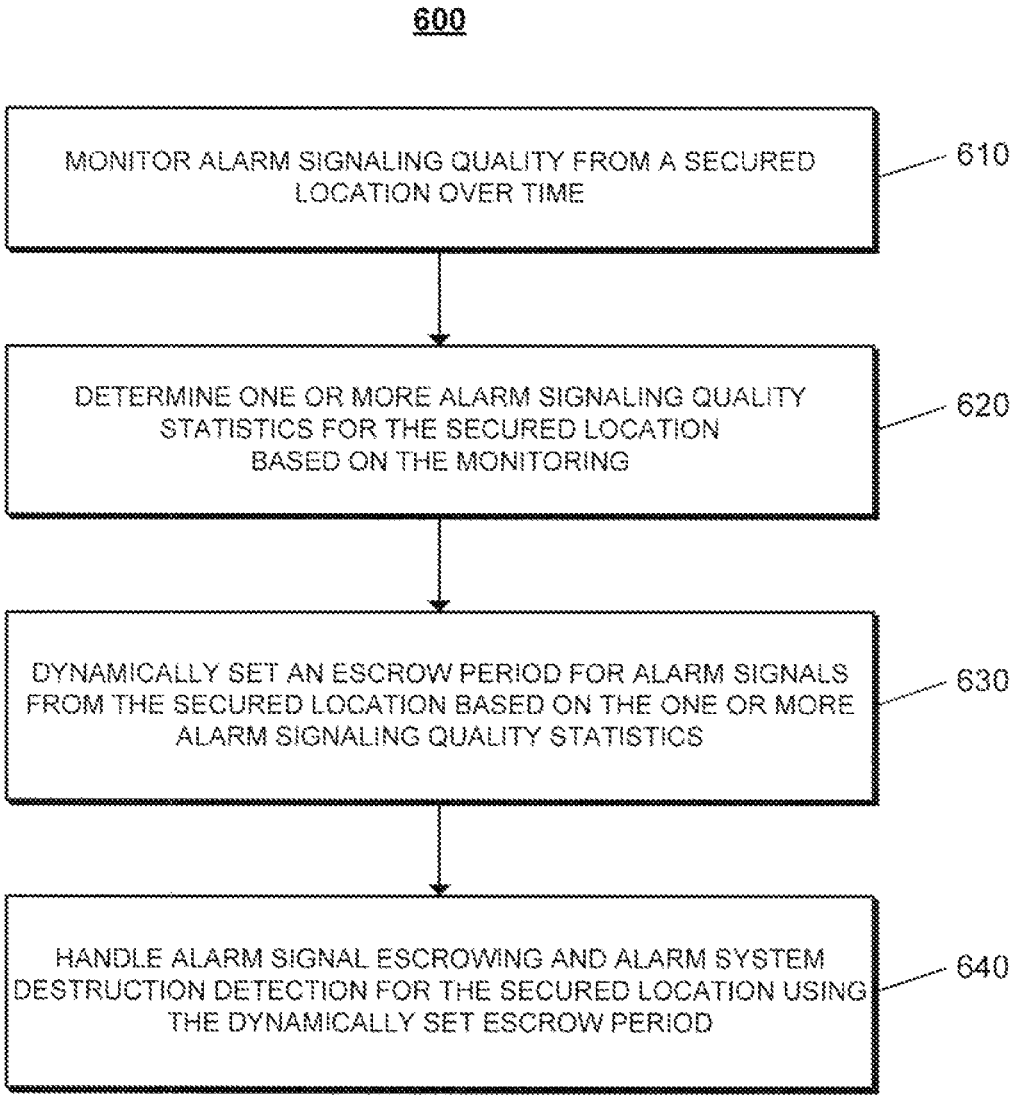
FIG. 6 is an exemplary flowchart illustrating a method for handling alarm signal escrowing and alarm system destruction detection for a secured location using a dynamically set escrow period.

FIG. 6 illustrates an example process 600 for handling alarm signal escrowing and alarm system destruction detection for a secured location using a dynamically set escrow period. The operations of the process 600 are described generally as being performed by the system 200. The operations of the process 600 may be performed by one of the components of the system 200 (e.g., the escrow site 240) or may be performed by any combination of the components of the system 200. The operations of the process 600 also may be performed by one of the components of the system 100 (e.g., the escrow site 125) or may be performed by any combination of the components of the system 100. In some implementations, operations of the process 600 may be performed by one or more processors included in one or more electronic devices.

The system 200 monitors alarm signaling quality from a secured location over time (610). For example, the system 200 tracks alarm signals received from a security system or an alarm signaling device at the secured location and measures characteristics of the received alarm signals associated with quality of the alarm signals. In this example, the system 200 may measure a signal strength of the alarm signals, latency of the alarm signals, a signal to noise ratio of the alarm signals, and any other characteristics that relate to quality of alarm signals received from the secured location.

The system 200 also may track reliability of communications with the secured location. For instance, the system 200 may track whether or not a particular alarm signaling communication results in a communication error.

In some examples, the system 200 tracks each alarm signal (or other communication/message) from the security system or alarm signaling device at the secured location and stores data associated with each alarm signal in a log. In these examples, the log may identify a time and date of each alarm signal, a type of the alarm signal, a source of the alarm signal, a signal strength of the alarm signal, a signal to noise ratio of the alarm signal, whether the alarm signal resulted in a communication error and, if a communication error occurred, the type of communication error, etc. Any other type of alarm signaling quality data may be stored in the log.

The system 200 may track alarm signals (or other communications/messages) from the secured location over an extended period of time (e.g., months, years). The system 200 also may track alarm signals (or other communications/messages) for multiple (e.g., many), different secured locations and develop an alarm signaling quality profile for each of the secured locations tracked.

The system 200 determines one or more alarm signaling quality statistics for the secured location based on the monitoring (620). For example, the system 200 may use tracked data stored during monitoring of the alarm signals exchanged with the secured location to compute alarm signaling quality statistics for the secured location. In this example, the system 200 may analyze a log of tracked alarm signaling data to derive several different types of statistics of the secured location. When the system 200 tracks signal strength of alarm signals exchanged with the secured location, the system 200 may determine an average (or median) signal strength for alarm signals exchanged with the secured location. In addition, when the system 200 tracks latency of alarm signals exchanged with the secured location, the system 200 may determine an average (or median) latency for alarm signals exchanged with the secured location. Further, when the system 200 tracks signal-to-noise ratio of alarm signals exchanged with the secured location, the system 200 may determine an average (or median) signal-to-noise ratio for alarm signals exchanged with the secured location. When the system 200 tracks communication errors for alarm signals exchanged with the secured location, the system 200 may determine an error rate for alarm signals exchanged with the secured location. Any other types of statistics that relate to quality of alarm signals may be determined.

In some examples, the system 200 may compute standard deviations of the alarm signaling quality characteristics and/or compute averages for a particular number (e.g., ten) of greatest outlier events for prior alarm signals from the secured location. In these examples, the computed standard deviations and/or statistics related to outlier events may be used to assess network latency.

In some implementations, the system 200 may compute an alarm signaling quality score that accounts for several types of alarm signaling quality statistics. For instance, the system 200 may compute an alarm signaling quality score that considers average signal strength for alarm signals exchanged with the secured location, average latency for alarm signals exchanged with the secured location, average signal-to-noise ratio for alarm signals exchanged with the secured location, and an error rate for alarm signals exchanged with the secured location. The system 200 may compute the alarm signaling quality score as a weighted combination of these factors, with weights being set for each factor in accordance with the relative importance of the corresponding factor in assessing signal quality. The alarm signaling quality may be reflective of multiple types of measurements and may be a general measurement of signal quality for the secured location.

In some examples, the system 200 may adjust the one or more alarm signaling quality statistics over time. In these examples, the system 200 may compute new alarm signaling quality statistics periodically (e.g., once a month) or may compute new alarm signaling quality statistics each time a new alarm signal from the secured location occurs. The system 200 may weight recent alarm signals more heavily than alarm signals received further in the past. In this regard, the alarm signaling quality statistics change over time and are most reflective of alarm signals currently exchanged with the secured location. For instance, as alarm signaling quality with the secured location deteriorates, the system 200 may quickly adapt the alarm signaling quality statistics to reflect the deterioration in alarm signaling quality. Likewise, as alarm signaling quality with the secured location improves, the system 200 may quickly adapt the alarm signaling quality statistics to reflect the improvement in alarm signaling quality.

The system 200 dynamically sets an escrow period for alarm signals from the secured location based on the one or more alarm signaling quality statistics (630). For example, the system 200 may set an escrow period that accounts for the alarm signaling quality with the secured location. In this example, the system 200 may set a relatively short escrow period when the one or more alarm signaling quality statistics indicate that alarm signaling quality with the secured location is relatively high. Because the alarm signaling quality with the secured location is relatively high, the system 200 is able to confidently set a relatively short escrow period, as failure to receive an alarm signal from the secured location has a relatively low likelihood of being a result of a communication error. This may provide faster detection of alarm destruction events for the secured location and, as such, may provide improved service in situations involving a crash and smash intrusion.

In addition, the system 200 may set a relatively long escrow period when the one or more alarm signaling quality statistics indicate that alarm signaling quality with the secured location is relatively low. Because the alarm signaling quality with the secured location is relatively low, the system 200 allows a longer time for receiving communications from the secured location, as failure to receive an alarm signal from the secured location has a relatively high likelihood of being a result of a communication error. This may provide improved detection of alarm destruction events for the secured location (e.g., less false alarms) because additional time is given to ensure failure to receive an alarm signal is not the result of a communication error.

In dynamically setting the escrow period, the system 200 may consider any combination of the alarm signaling quality statistics discussed throughout this disclosure. The system 200 may apply one or more rules to the alarm signaling quality statistics and set the escrow period based on application of the rules. For example, when the system 200 computes an alarm signaling quality score, the system 200 may compute the escrow period (e.g., wait time) by applying the alarm signaling quality score to an equation that results in the escrow period. In another example, the system 200 may compare the alarm signaling quality score to a set of thresholds that are each associated with a particular escrow period and dynamically set the escrow period to the particular escrow period associated with the matching threshold range (e.g., set the escrow period to four minutes when the score is between zero and one, set the escrow period to three minutes when the score is between one and two, and set the escrow period to two minutes when the score is greater than two).

When the system 200 computes standard deviations and/or statistics related to outlier events, the system 200 may use the standard deviations and/or statistics related to outlier events to set the escrow period. For instance, when the system 200 detects relatively few outlier events (e.g., none), the system 200 may set a relatively short escrow period. However, when the system 200 detects heavy outlier timestamps indicating relatively frequent outlier events, the system 200 may set a relatively long escrow period to account for possible outlier events.

In some examples, the system 200 may adjust the escrow period dynamically over time. In these examples, the system 200 may determine a new escrow period periodically (e.g., once a month) or may determine a new escrow period each time new alarm signaling quality statistics are computed. The system 200 may weight recent alarm signaling quality statistics more heavily than alarm signaling quality statistics computed further in the past. In this regard, the escrow period changes over time and is most reflective of alarm signals currently exchanged with the secured location. For instance, as alarm signaling quality with the secured location deteriorates, the system 200 may quickly increase the escrow period to reflect the deterioration in alarm signaling quality. Likewise, as alarm signaling quality with the secured location improves, the system 200 may quickly decrease the escrow period to reflect the improvement in alarm signaling quality.

The system 200 handles alarm signal escrowing and alarm system destruction detection for the secured location using the dynamically set escrow period (640). For instance, the system 200 uses the dynamically set escrow period to determine how long to wait until making a determination that an alarm system destruction event has occurred. In response to the alarm system destruction event, the system 200 may notify a central monitoring system and/or a user associated with the secured location. Any of the techniques described throughout this disclosure may be used in handling alarm signal escrowing and alarm system destruction detection with the escrow period being the dynamically set escrow period.

Although the techniques described above with respect to FIG. 6 have been described in the context of dynamically setting an escrow period, the techniques may be used in other contexts of handling alarm signal escrowing and alarm system destruction detection for the secured location. For example, the system 200 may determine whether or not additional measures to reduce false alarms should be taken based on the one or more alarm signaling quality statistics. In this example, the system 200 may require a confirmation pinging sequence (see FIG. 7) to occur before issuing an alarm system destruction (e.g., crash and smash) signal when the one or more alarm signaling quality statistics indicate that alarm signaling quality with the secured location is relatively low. When the one or more alarm signaling quality statistics indicate that alarm signaling quality with the secured location is relatively high, the system 200 may not require the confirmation pinging sequence to occur before issuing an alarm system destruction (e.g., crash and smash) signal.

Figure 7:
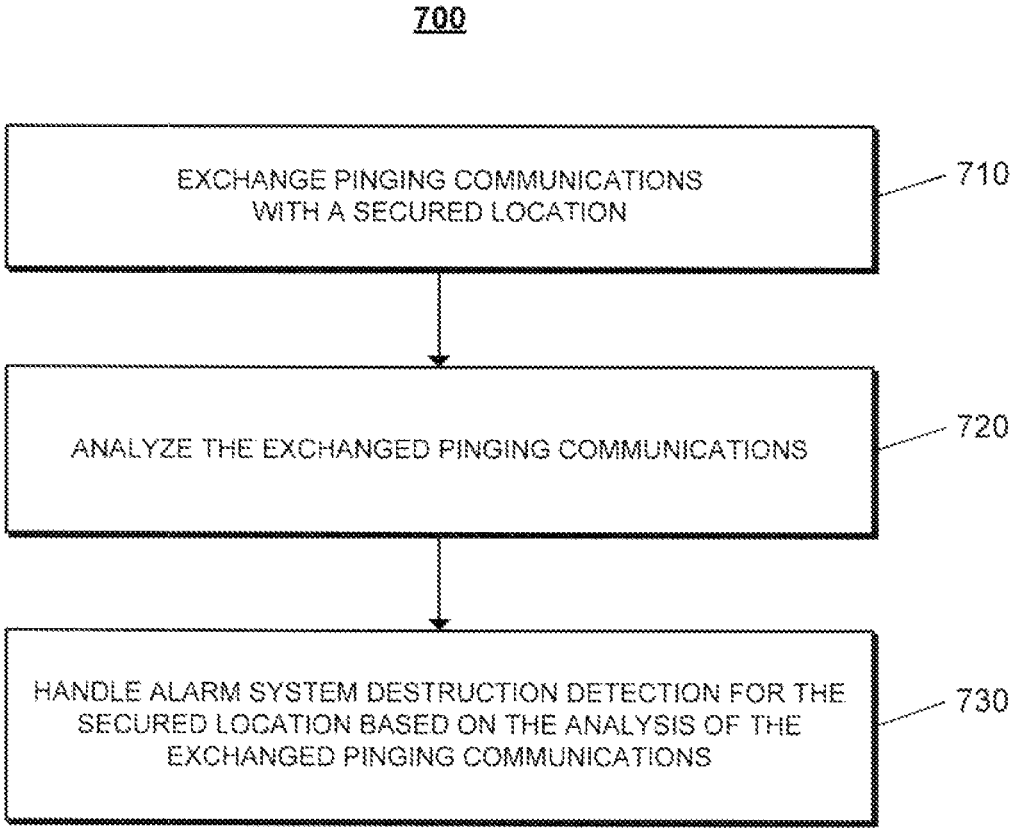
FIG. 7 is an exemplary flowchart illustrating a method for handling alarm system destruction detection for a secured location based on analysis of exchanged pinging communications.

FIG. 7 illustrates an example process 700 for handling alarm system destruction detection for a secured location based on analysis of exchanged pinging communications. The operations of the process 700 are described generally as being performed by the system 200. The operations of the process 700 may be performed by one of the components of the system 200 (e.g., the escrow site 240) or may be performed by any combination of the components of the system 200. The operations of the process 700 also may be performed by one of the components of the system 100 (e.g., the escrow site 125) or may be performed by any combination of the components of the system 100. In some implementations, operations of the process 700 may be performed by one or more processors included in one or more electronic devices.

The system 200 exchanges pinging communications with a secured location (710). For example, the system 200 facilitates exchange of pinging communications between a security system or alarm signaling device at the secured location and a server at an escrow site. The pinging communications may be communications that merely indicate whether or not the relevant device is operating properly and able to receive/send communications. The pinging communications may be initiated by the security system or alarm signaling device at the secured location or the server at the escrow site.

In some examples, the security system or alarm signaling device at the secured location may initiate a pinging communication that indicates that the security system or alarm signaling device at the secured location is operating properly and awake. In these examples, the server at the escrow site may respond with an acknowledgement that the pinging communication has been received.

In other examples, the server at the escrow site may initiate a pinging communication to the security system or alarm signaling device at the secured location that requests status of the security system or alarm signaling device at the secured location. In these examples, the security system or alarm signaling device at the secured location responds to the pinging communication with its status when the pinging communication is received.

The system 200 may exchange the pinging communications over any type of network described throughout this disclosure. The system 200 may leverage an Internet-protocol based network (e.g., the Internet) for the pinging communications because pinging communications over Internet-protocol based networks have relatively low cost and, therefore, may be exchanged at a relatively high frequency.

In some implementations, the system 200 exchanges pinging communications periodically during operation. In these implementations, the pinging communications may be persistent or continuous during operation of the system 200. For instance, the pinging communications may be exchanged as a heartbeat signal with pinging communications being exchanged at a relatively fast frequency (e.g., one pinging communication per second or faster). The security system or alarm signaling device at the secured location may send a repeated pattern of "I'm awake," "I'm awake," etc. pinging communications, so the server at the escrow site is able to closely monitor the status of the security system or alarm signaling device at the secured location. The persistent or continuous pinging may begin in response to detection of an alarm or potential alarm event.

In some examples, the system 200 exchanges pinging communications in response to alarm signaling events. In these examples, rather than simply monitoring for communications from the secured location during the escrow period, the system 200 may initiate pinging communications to the secured location in response to receipt of a potential alarm event signal. The system 200 also may initiate communications to the secured location in response to detecting that the escrow period has expired. In this regard, the system 200 may attempt to ping the secured location prior to signaling that an alarm destruction event has occurred.

The system 200 analyzes the exchanged pinging communications (720). For instance, the system 200 may analyze whether or not pinging communications are being exchanged as expected. When the security system or alarm signaling device at the secured location initiates pinging communications, the system 200 may analyze whether or not pinging communications are being received from the security system or alarm signaling device at the secured location as expected (e.g., at the frequency the security system or alarm signaling device is set to initiate pinging communications). When the server at the escrow site initiates pinging communications, the system 200 may analyze whether or not acknowledgments to the pinging communications are being received from the security system or alarm signaling device at the secured location.

In some implementations, the system 200 may track the timing of the last communication exchanged between the security system or alarm signaling device at the secured location and the server at the escrow site. The system 200 also may track the number of expected pinging communications (e.g., acknowledgements) that have not been received and/or the number of expected pinging communications (e.g., acknowledgements) that have been received.

The system 200 handles alarm system destruction detection for the secured location based on the analysis of the exchanged pinging communications (730). For instance, the system 200 handles alarm system destruction detection for the secured location based on whether or not pinging communications are being exchanged as expected. The system 200 may start, stop, or reset the escrow period based on the analysis of the exchanged pinging communications or may detect alarm destruction events based on the analysis of the exchanged pinging communications.

In some implementations, the system 200 uses the pinging communications to delay onset of a timer that measures an escrow period for an alarm signal. In these implementations, when a potential alarm event is detected, the system 200 initiates exchange of pinging communications in response to the detection of the potential alarm event. The system 200 may reset the start of the escrow period (e.g., reset a timer that measures the escrow period) each time a pinging communication is properly exchanged. In this regard, the system 200 is able to accurately determine the time when the security system or alarm signaling device at the secured location ceased proper operation (e.g., was disabled) and measure the escrow period from the most recent communication.

In some examples, the system 200 detects an alarm system destruction event based on a tracked number of missed pinging communications. In these examples, the system 200 may determine whether a particular number of pinging communications (e.g., anticipated pinging communications the security system is expected to initiate or acknowledgements to pinging communications initiated by the escrow site) have been missed. In response to a determination that the particular number of pinging communications have been missed (e.g., when ten pinging communications in a row have been detected as missed), the system 200 determines that an alarm system destruction event has occurred and handles the alarm system destruction event appropriately, such as by using any of the techniques described throughout this disclosure.

Figure 8:
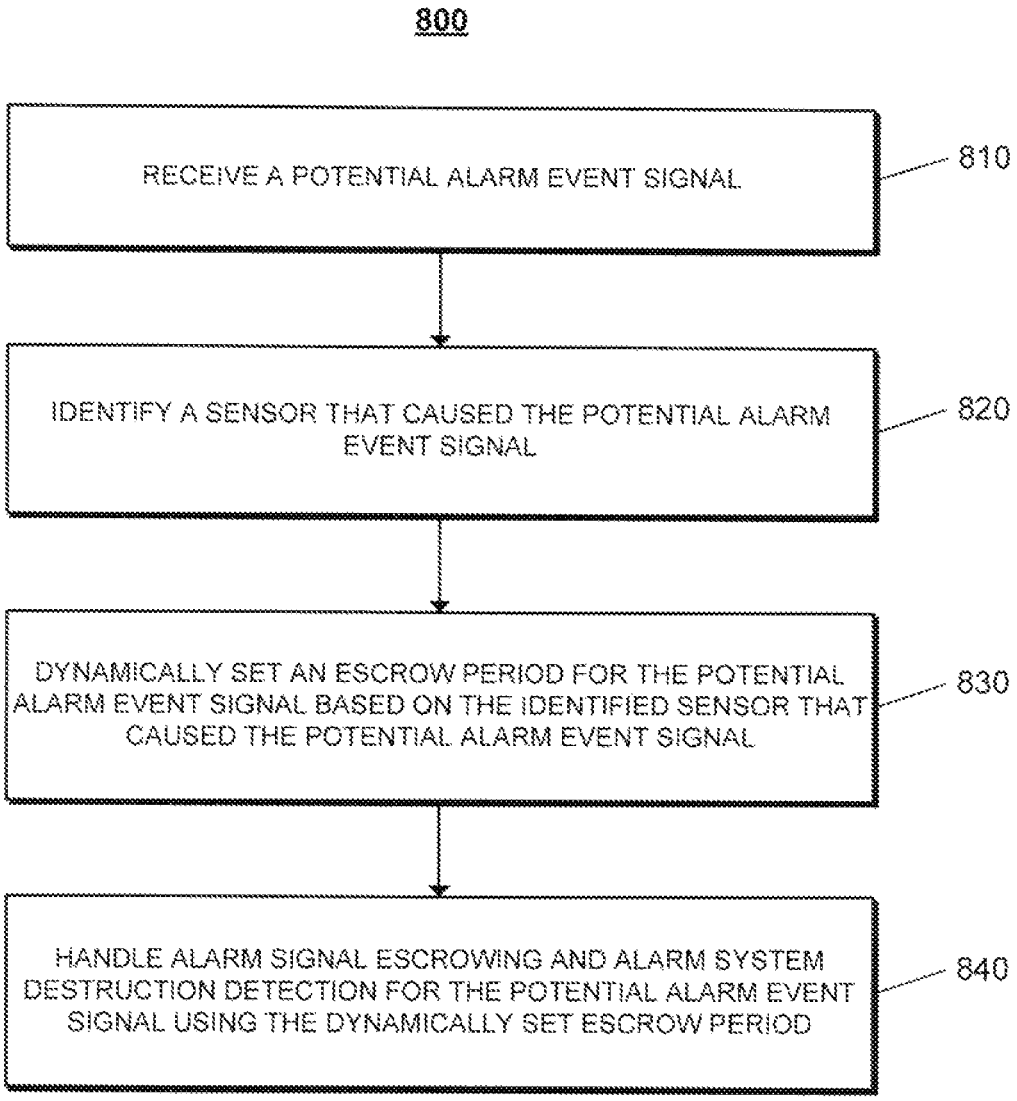
FIG. 8 is an exemplary flowchart illustrating a method for handling alarm signal escrowing and alarm system destruction detection for a potential alarm event signal using a dynamically set escrow period.

FIG. 8 illustrates an example process 800 for handling alarm signal escrowing and alarm system destruction detection for a potential alarm event signal using a dynamically set escrow period.

The operations of the process 800 are described generally as being performed by the system 200. The operations of the process 800 may be performed by one of the components of the system 200 (e.g., the escrow site 240) or may be performed by any combination of the components of the system 200. The operations of the process 800 also may be performed by one of the components of the system 100 (e.g., the escrow site 125) or may be performed by any combination of the components of the system 100. In some implementations, operations of the process 800 may be performed by one or more processors included in one or more electronic devices.

The system 200 receives a potential alarm event signal (810) and identifies a sensor that caused the potential alarm event signal (820). For example, a server at an escrow site may receive, over a network, a signal sent by a security system or alarm signaling device that monitors a secured location. In this example, the security system that monitors the secured location may include multiple sensors (e.g., door contact sensors, window contact sensors, glass break sensors, motion sensors, etc.) and the potential alarm event signal may be sent in response to at least one of the multiple sensors detecting an event that signifies a potential alarm event.

The system 200 also may, in response to at least one of the multiple sensors detecting an event that signifies a potential alarm event, start tracking an entry delay period in which a user may cancel the potential alarm event (e.g., by entering a pass code to the security system) such that an actual alarm event is not detected. The entry delay period may vary based on which sensor detected the potential alarm event. For instance, a front door sensor may have an entry delay period of thirty seconds because the alarm panel is positioned close to the front door and only a relatively short period of time is needed to provide input canceling the potential alarm event when a user enters the front door. On the other hand, a garage door sensor may have an entry delay period of five minutes because the alarm panel is positioned far from the garage door and a relatively long period of time is needed to provide input canceling the potential alarm event when a user enters the garage door.

In some implementations, the potential alarm event signal includes data (e.g., front door, garage door, hallway motion sensor, etc.) indicating which sensor caused the potential alarm event. In these implementations, the server at the escrow site analyzes the potential alarm event signal to extract the sensor identification data from the potential alarm event signal and use the sensor identification data to identify which sensor caused the potential alarm event. The sensor identification data may be sent in a communication that is separate from the potential alarm event signal. The sensor identification data also may include an entry delay time associated with the identified sensor.

The system 200 dynamically sets an escrow period for the potential alarm event signal based on the identified sensor that caused the potential alarm event signal (830). For example, the system 200 may set an escrow period that accounts for the identified sensor that caused the potential alarm event signal. In this example, the system 200 may set a relatively short escrow period when the identified sensor has a relatively short entry delay period and is known to be relatively close to the control panel that allows potential alarm event cancellation. The system 200 may set a relatively long escrow period when the identified sensor has a relatively long entry delay period and is known to be relatively far from the control panel that allows potential alarm event cancellation. By adjusting the escrow period to account for which sensor triggered the potential alarm event, the system 200 may reduce false detection rates because additional time is given for sensors that take a relatively long time to cancel.

In some implementations, the system 200 stores a data structure (e.g., a table) that maps sensors to escrow periods. In these implementations, the system 200 compares the identified sensor to the data structure and identifies the escrow period corresponding to the identified sensor based on the comparison. The system 200 then dynamically sets the escrow period for the potential alarm event to the escrow period mapped to using the data structure. The escrow periods defined in the data structure may be set by an alarm company or may be set by a user based on user input provided by the user (e.g., through a web interface that allows the user to adjust alarm settings).

In one example, a user's home security system may include a front door sensor and a garage door sensor. In this example, the front door sensor may have an entry delay period of sixty seconds because the alarm panel is positioned close to the front door and only a relatively short period of time is needed to provide input canceling the potential alarm event when the user enters the front door. The garage door sensor may have an entry delay period of five minutes because the alarm panel is positioned far from the garage door and a relatively long period of time is needed to provide input canceling the potential alarm event when the user enters the garage door. In this example, the escrow period may be set based on the entry delay period corresponding to the sensor that detected a potential alarm event. For instance, the escrow period may be set to thirty seconds longer than the entry delay period. In this instance, the escrow period is set to ninety seconds when the front door sensor detects the potential alarm event and set to five minutes and thirty seconds when the garage door detects the potential alarm event. As another example, the escrow period may be set to a multiple of the entry delay period (e.g., one and a half times or two times the entry delay period). When the escrow period is set to one and a half times the entry delay period, the escrow period is set to ninety seconds when the front door sensor detects the potential alarm event and set to seven minutes and thirty seconds when the garage door detects the potential alarm event.

The system 200 also may set escrow periods based on a history of interactions associated with particular sensors. For example, the system 200 may track how quickly a cancellation signal is typically (e.g., on average) received when a particular sensor detects a potential alarm event and a user provides input canceling the potential alarm event. In this example, the system 200 may use the average time it takes to receive the cancellation signal to set the escrow period. The average time may be different than the entry delay period and may allow for faster detection of alarm system destruction events. For instance, suppose a front door sensor has an entry delay period of sixty seconds, but the system 200 detects that a cancellation signal for potential alarm events detected based on the first door sensor are received on average in forty-five seconds. In this instance, the system 200 may set the escrow period to thirty seconds longer than the average cancellation signal time and, therefore, set the escrow period at seventy-five seconds. The seventy-five second escrow period is shorter than the ninety second escrow period described above when using the entry delay period to set the escrow period. When using the history of interactions associated with particular sensors to set escrow periods, the system 200 may ensure that the escrow period is longer than the entry delay period, even when the history suggests that cancellation signals are received relatively quickly.

The system 200 handles alarm signal escrowing and alarm system destruction detection for the potential alarm event signal using the dynamically set escrow period (840). For instance, the system 200 uses the dynamically set escrow period to determine how long to wait until making a determination that an alarm system destruction event has occurred. In response to the alarm system destruction event, the system 200 may notify a central monitoring system and/or a user associated with the secured location. Any of the techniques described throughout this disclosure may be used in handling alarm signal escrowing and alarm system destruction detection with the escrow period being the dynamically set escrow period.

Figure 9:
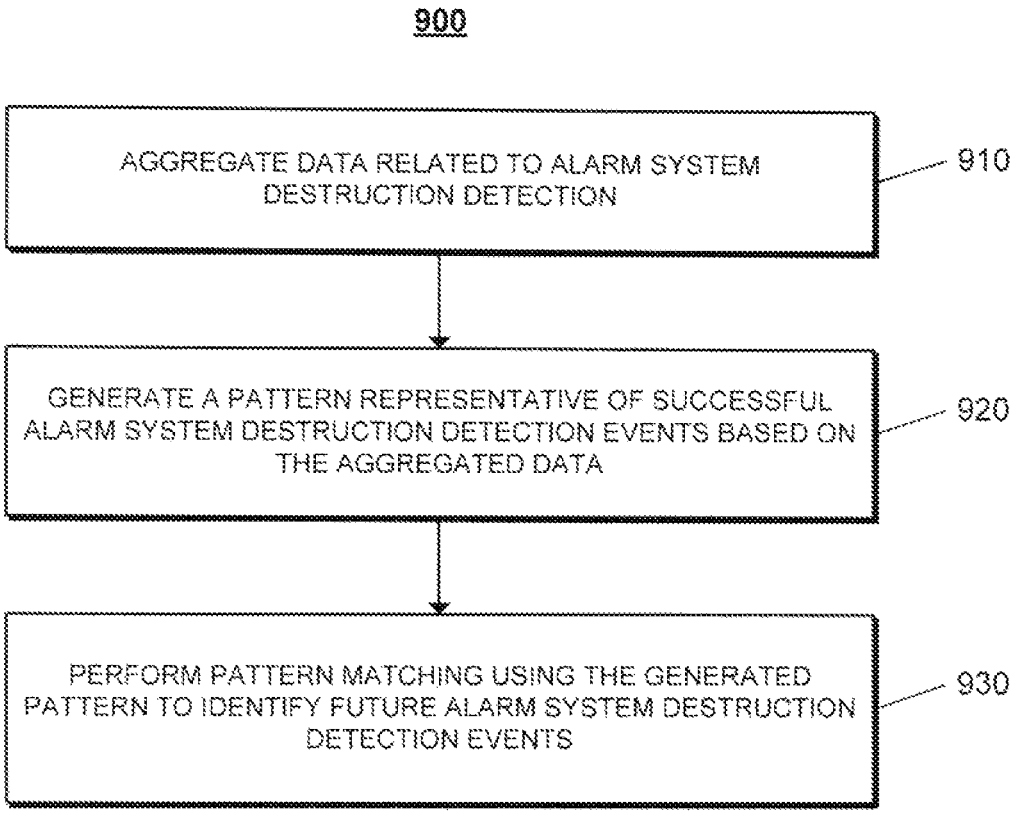
FIG. 9 is an exemplary flowchart illustrating a method for identifying alarm system destruction detection events.

FIG. 9 illustrates an example process 900 for identifying alarm system destruction detection events. The operations of the process 900 are described generally as being performed by the system 200. The operations of the process 900 may be performed by one of the components of the system 200 (e.g., the escrow site 240) or may be performed by any combination of the components of the system 200. The operations of the process 900 also may be performed by one of the components of the system 100 (e.g., the escrow site 125) or may be performed by any combination of the components of the system 100. In some implementations, operations of the process 900 may be performed by one or more processors included in one or more electronic devices.

The system 200 aggregates data related to alarm system destruction detection (910). For example, the system 200 may receive alarm system data related to many events from many different monitored locations and may identify alarm system data associated with instances in which alarm system destruction events were incorrectly detected, instances in which alarm system destruction events were correctly detected, and instances in which alarm system destruction events occurred, but were not detected. In this example, the system 200 may track alarm system data and identify whether the tracked data is associated with a particular type of alarm system destruction event (e.g., correctly detected, incorrectly detected, or undetected). The system 200 may aggregate data in geographic regions to detect patterns of a large number of alarm system destruction events in a geographic region. The system 200 also may aggregate data of other types of alarm events in an attempt to correlate the other types of alarm events to occurrence of alarm system destruction events (e.g., a large number of regular alarm events may foreshadow alarm system destruction events because the criminals completing the regular alarm events may become more sophisticated over time). The system 200 further may track other types of data which may correlate to alarm system destruction events (e.g., crime incident data in which crime rate is used to forecast alarm system destruction events). The system 200 may store all of the tracked data in a database.

The system 200 generates a pattern representative of successful alarm system destruction detection events based on the aggregated data (920). For instance, the system 200 analyzes the aggregated data and identifies one or more patterns that correlate to or are indicative of alarm system destruction events. The pattern may be regionalized to detect patterns associated with particular regions. In generating the pattern, the system 200 may consider successful detections and identify similar alarm system behavior in the successful detections. The system 200 also may consider unsuccessful detections and attempt to identify similar alarm system behavior in the unsuccessful detections that is not present in the successful detections and discount the identified behavior in the pattern. The system 200 may update the pattern continuously as new data is aggregated and analyzed. By updating the pattern continuously, the system 200 may account for recent changes and adapt to different techniques of alarm system destruction and new crime enterprises.

The system 200 performs pattern matching using the generated pattern to identify future alarm system destruction detection events (930). For example, the system 200 compares the generated pattern to future alarm system behavior patterns to identify similar patterns that indicate alarm system destruction events. In this example, because the generated pattern accounts for a large amount of data, the system 200 may be able to provide enhanced alarm system destruction detection (e.g., faster detection and less false alarms).

The system 200 also may use the generated pattern to modify certain parameters of detecting alarm system destruction events. For instance, when the generated pattern suggests an increasing number of alarm system destruction events in a particular region (e.g., based on alarm system data and crime incident data for the particular region), the system 200 may reduce the escrow period for alarm signals from alarm systems in the particular region to provide faster detection of alarm system destruction events in the particular region.

In some implementations, the system 200 may impose a double sensor requirement in detecting an alarm system destruction event. For instance, in some security systems, a user may have to trigger multiple sensors when entering a building monitored by the security system and destroying (or otherwise disabling) the alarm signaling component of the security system. Consider a building that includes a front door sensor and a motion sensor that detects motion along a hallway leading from the front door. The alarm signaling component of the security system may be positioned in the building such that an intruder entering through the front door must pass through the hallway covered by the motion sensor to reach the alarm signaling component and destroy or otherwise disable it. In this scenario, when an intruder enters the building through the front door and destroys the alarm signaling component, the system 200 detects triggering of the front door sensor and triggering of the motion sensor prior to the alarm signaling component being destroyed. Accordingly, when the front door sensor is the sensor that causes the potential alarm event, the system 200 may determine whether the motion sensor triggers and detect an alarm system destruction event only when the motion sensor triggers in addition to the front door sensor. In this regard, the double sensor requirement may assist in reducing false detection of alarm system destruction events, such as when a weather condition (e.g., high wind or a lightning strike) causes a first sensor to trigger and also renders the alarm signaling component inoperative (e.g., due to a power or communication failure) near the same time. Using the double sensor requirement would prevent the weather condition situation from resulting in detection of an alarm system destruction event because the weather condition would not trigger the motion sensor and, therefore, the system 200 would not detect an alarm system destruction, even though communication with the alarm signaling component has ceased. Although the system 200 may take appropriate action in handling this situation (e.g., providing alerts to a user and/or proper authorities), the system 200 does not handle the situation with the urgency of a suspected alarm system destruction event. To enhance detection of false alarms occurring as a result of weather conditions, the system 200 may monitor weather forecasts and reporting and account for weather information in assessing alarm patterns.

In some examples, a security system may include multiple transmission points (e.g., wireless and/or wireline) outside of a building through which the security system can communicate with a central monitoring station or an alarm server. In these examples, the security system may use techniques described throughout this disclosure to escrow alarm signals and detect alarm system destruction events within the building. For instance, a secondary transmission component may communicate with a primary transmission component and perform operations similar to the escrow site. When the secondary transmission component stops receiving communications from the first transmission component, the secondary transmission component may detect that the first transmission component has been destroyed (or otherwise disabled) and take over communications with the central monitoring station or the alarm server. In this regard, the multiple transmission components provide multiple paths outside of a building for alarm data and, thus, make destroying or disabling all alarm system communication from a building more difficult.

The described systems, methods, and techniques may be implemented in digital electronic circuitry, computer hardware, firmware, software, or in combinations of these elements.

Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language.

Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A method comprising:

determining, by a secondary transmission point i) for a property ii) that provides backup network access for a security control panel at the property to a primary transmission point, a first time period since the secondary transmission point received a communication from the primary transmission point, wherein the security control panel is separate from the primary transmission point and the secondary transmission point;

determining that the first time period since the communication was received from the primary transmission point satisfies a first threshold time period for the primary transmission point;

determining a second time period since the secondary transmission point received a message from the security control panel, the message being different from the communication;

in response to determining that the first time period since the communication was received from the primary transmission point satisfies the first threshold time period for the primary transmission point, determining whether the second time period since the message was received from the security control panel satisfies a second threshold time period for the security control panel; and selectively determining to perform one or more automated actions for the property or to skip performing the one or more automated actions for the property using a result of the determination whether the second time period since the message was received from the security control panel satisfies the second threshold time period for the security control panel.

2. The method of claim 1, comprising:

determining that the second time period since a message was received from the security control panel satisfies the second threshold time period; and in response to determining that the second time period since a message was received from the security control panel satisfies the second threshold time period, performing one or more automated actions for the property.

3. The method of claim 1, comprising:

receiving sensor data from a sensor at the property, wherein:

selectively determining to perform the one or more automated actions for the property or to skip performing the one or more automated actions for the property uses the result of the determination whether the second time period since a message was received from the security control panel satisfies the second threshold time period and the sensor data.

4. The method of claim 3, comprising:

selecting, from a plurality of threshold time periods and using a type of the sensor, the second threshold time period.

5. The method of claim 1, wherein the primary transmission point or the secondary transmission point comprises one or more devices that implement at least a portion of a transmission path between the security control panel and an central monitoring system that monitors multiple properties.

6. The method of claim 1, wherein the primary transmission point comprises one or more devices that implement at least a portion of at least one of a wired connection or a wireless connection between the security control panel and an central monitoring system that monitors multiple properties.

7. The method of claim 1, comprising sending, to a central monitoring system, a message indicating that the security control panel was likely damaged.

8. A system comprising one or more computers and one or more storage devices on which are stored instructions that are operable, when executed by the one or more computers, to cause the one or more computers to perform operations comprising:

determining, by the system i) for a property ii) that provides backup network access for a security control panel at the property to a primary transmission point, a first time period since the system received a communication from the primary transmission point, wherein the security control panel is separate from the primary transmission point and the system;

determining that the first time period since the communication was received from the primary transmission point satisfies a first threshold time period for the primary transmission point;

determining a second time period since the system received a message from the security control panel, the message being different from the communication;

in response to determining that the first time period since the communication was received from the primary transmission point satisfies the first threshold time period for the primary transmission point, determining whether the second time period since the message was received from the security control panel satisfies a second threshold time period for the security control panel; and performing one or more automated actions for the property or to skip performing the one or more automated actions for the property using a result of the determination whether the second time period since the message was received from the security control panel satisfies the second threshold time period for the security control panel.

9. The system of claim 8, wherein the system is physically at an offsite location separate from the property.

10. The system of claim 8, wherein the system is physically located at the property.

11. The system of claim 8, wherein performing the one or more automated actions for the property comprises sending, to a central monitoring system, a message indicating that the security control panel was likely damaged.

12. The system of claim 8, the operations comprising:

receiving sensor data from a sensor at the property, wherein:

performing the one or more automated actions for the property uses the sensor data.

13. The system of claim 12, the operations comprising:

selecting, from a plurality of threshold time periods and using a type of the sensor, the threshold time period.

14. One or more non-transitory computer storage media encoded with instructions that, when executed by one or more computers, cause the one or more computers to perform operations comprising:

determining, by a secondary transmission point i) for a property ii) that provides backup network access for a security control panel at the property to a primary transmission point, a first time period since the secondary transmission point received a communication from the primary transmission point, wherein the security control panel is separate from the primary transmission point and the secondary transmission point;

determining that the first time period since the communication was received from the primary transmission point satisfies a first threshold time period for the primary transmission point;

determining a second time period since the secondary transmission point received a message from the security control panel, the message being different from the communication;

in response to determining that the first time period since the communication was received from the primary transmission point satisfies the first threshold time period for the primary transmission point, determining that the second time period since the message was received from the security control panel satisfies a second threshold time period for the security control panel; and in response to determining that the second time period since the message was received from the security control panel satisfies the second threshold time period, performing one or more automated actions for the property for the security control panel.

15. The one or more non-transitory computer storage media of claim 14, the operations comprising:

determining that the second time period since a message was received from the security control panel satisfies the second threshold time period; and in response to determining that the second time period since a message was received from the security control panel satisfies the second threshold time period, performing one or more automated actions for the property.

16. The one or more non-transitory computer storage media of claim 14, the operations comprising:

receiving sensor data from a sensor at the property, wherein:

determining to perform the one or more automated actions for the property uses the sensor data.

17. The one or more non-transitory computer storage media of claim 16, the operations comprising:

selecting, from a plurality of threshold time periods and using a type of the sensor, the second threshold time period.

18. The one or more non-transitory computer storage media of claim 14, wherein the primary transmission point or the secondary transmission point comprises one or more devices that implement at least a portion of a transmission path between the security control panel and an central monitoring system that monitors multiple properties.

19. The one or more non-transitory computer storage media of claim 14, wherein the primary transmission point comprises one or more devices that implement at least a portion of at least one of a wired connection or a wireless connection between the security control panel and an central monitoring system that monitors multiple properties.

20. The one or more non-transitory computer storage media of claim 14, wherein performing the one or more automated actions for the property comprises sending, to a central monitoring system, a message indicating that the security control panel was likely damaged.

* * * * *